US009027493B2

(12) United States Patent
Hultzer

(10) Patent No.: US 9,027,493 B2
(45) Date of Patent: May 12, 2015

(54) SAIL BEARING

(75) Inventor: Vernon Hultzer, Annapolis, MD (US)

(73) Assignee: Wichard Inc., Fairfax, VT (US)

( * ) Notice: Subject to any disclaimer, the term of this patent is extended or adjusted under 35 U.S.C. 154(b) by 241 days.

(21) Appl. No.: 13/600,783

(22) Filed: Aug. 31, 2012

(65) Prior Publication Data

US 2014/0060410 A1 Mar. 6, 2014

(51) Int. Cl.
*B63H 9/04* (2006.01)
*B63H 9/10* (2006.01)

(52) U.S. Cl.
CPC ..... *B63H 9/1028* (2013.01)

(58) Field of Classification Search
CPC ..... B63H 9/08; B63H 9/10; B63H 9/1021; B63H 9/1028; B63H 9/1035; B63H 9/1042; B63H 9/1092
USPC ..... 114/102.1, 102.12, 102.15, 102.16, 114/102.18, 104–108
See application file for complete search history.

(56) References Cited

U.S. PATENT DOCUMENTS 3,749,042 A * 7/1973 Jackson ..... 114/106
3,789,790 A * 2/1974 Crall ..... 114/106
3,958,523 A * 5/1976 Holmes et al. ..... 114/106
3,964,419 A * 6/1976 Uecker ..... 114/106
3,980,036 A * 9/1976 Crall ..... 114/106
4,090,461 A * 5/1978 Rusich ..... 114/107
4,122,560 A 10/1978 Baker
4,267,790 A * 5/1981 Hood ..... 114/106
4,267,791 A * 5/1981 Ingouf ..... 114/106
4,723,499 A * 2/1988 Furgang ..... 114/106
5,520,562 A 5/1996 Eddy
5,619,946 A * 4/1997 Wallasch ..... 114/106
7,975,635 B2 7/2011 Greghi
2010/0282152 A1 11/2010 Cook et al.

FOREIGN PATENT DOCUMENTS

EP 1580118 A2 9/2005
GB 485169 A 5/1938

* cited by examiner

*Primary Examiner* — Daniel V Venne
(74) *Attorney, Agent, or Firm* — Laubscher, Spendlove & Laubscher, P.C.

(57) ABSTRACT

A bearing for a sail furling apparatus includes a spherical body having a longitudinal axis and containing a cylindrical longitudinal through-opening for receiving a cable of the furling apparatus. The body is freely rotatable on the cable and protects the furled sail from abrasive contact with the cable. The body contains a plurality of spaced longitudinal channels in the outer surface to define a plurality of spaced flutes to further space the furled sail from the cable and to facilitate smooth furling and unfurling of the sail.

9 Claims, 3 Drawing Sheets

SAIL BEARING

BACKGROUND OF THE INVENTION

In sailing, the sails can be furled and unfurled to define the amount of sail area being exposed to the wind. Reel furling involves winding a sail about an elongated cable or cord. Spinnakers in particular are opened and closed by reel furling. Once furled, the spinnaker can be stored in a storage bag on the sailboat. A major drawback of reel furling apparatus is that the sail cloth is often grabbed or snagged by the cable. During repeated furling and unfurling the adhesion of the sail material to the cable damages the sail cloth, reducing its performance and shortening its life.

BRIEF DESCRIPTION OF THE PRIOR ART

The Greghi U.S. Pat. No. 7,975,635 discloses a device for furling and unfurling asymmetric sails such as spinnakers. The device includes an inner foil which may include a single cable or two cables and an outer or sheath foil. The sheath foil is preferably formed of a foamed rubber.

While the Greghi device operates satisfactorily, the foamed rubber sheath foil has a tendency to become deformed over time by repeated furling and unfurling of a sail, thereby diminishing its effectiveness. Moreover, the sail does not always wind evenly about the foils. This increases the wear on the sail cloth.

The present invention was developed in order to overcome these and other drawbacks of the prior device by providing a sail bearing for a furling and unfurling device which protects the sail cloth from abrasion against the furling cable while improving the ease and efficiency of the furling operation.

SUMMARY OF THE INVENTION

Accordingly, it is a primary object of the invention to provide a device for furling and unfurling a sail which includes an elongated cable having a fitting at one end for connection with a corner of a sail. A swivel is connected with the other end of the cable and another corner of the sail is connected with the swivel. A plurality of bearings are freely rotatably mounted on the cable between the fitting and the swivel. When the swivel is rotated in a first direction, the cable and fitting are also rotated to furl the sail on the bearings. When the swivel is released and rotated in the opposite direction, the sail is unfurled.

Each bearing has a spherical configuration and contains a longitudinal cylindrical through-opening for receiving the cable. The bearings further contain a plurality of spaced grooves or channels in the outer surface and extending parallel to the through-opening. The channels define a plurality of flutes on the bearing outer surface. The channels are preferably equally spaced about the circumference of the bearing.

The bearings are preferably formed of a rigid material such as synthetic plastic. In order to prevent the cumulative weight of the bearings from diminishing their performance, one or more bearing locks are connected with the cables at spaced intervals along the length of the cable. Each lock thus supports the weight of the bearings above the lock, so that the bearings below the lock are freely rotatable.

BRIEF DESCRIPTION OF THE FIGURES

Other objects and advantages of the invention will become apparent from a study of the following specification when viewed in the light of the accompanying drawing in which.

DETAILED DESCRIPTION

Figure 1:
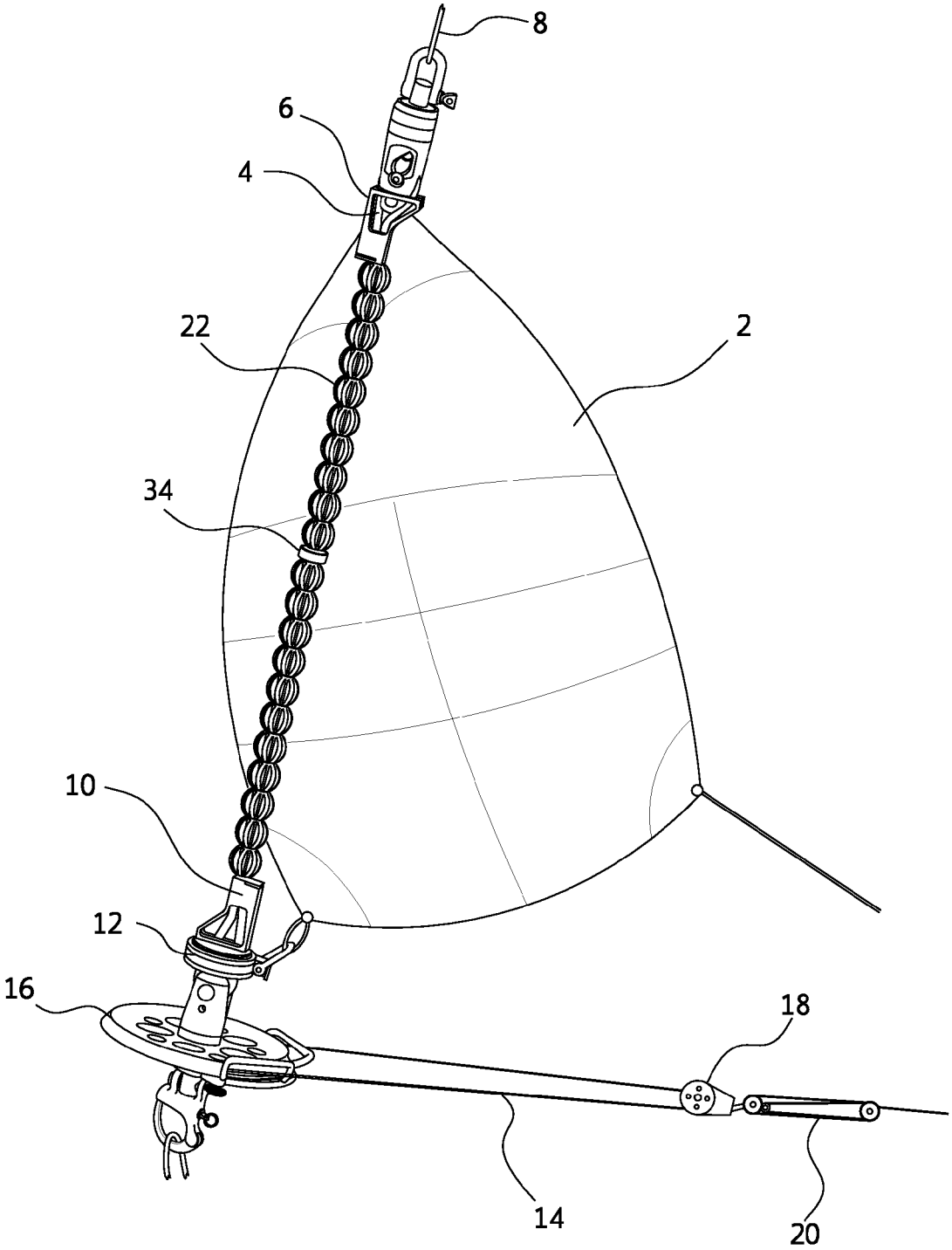
FIG. 1 is a perspective view of an apparatus for furling and unfurling a sail according to the invention.
Figure 2:
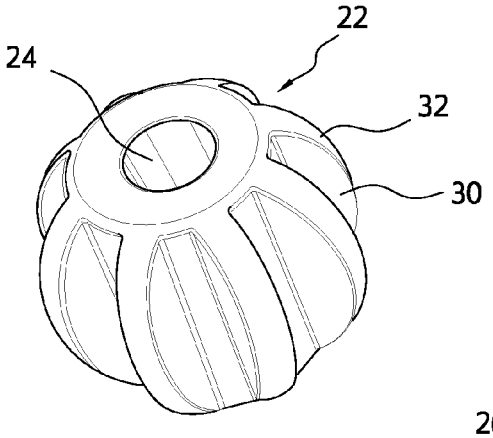
FIG. 2 is a perspective view of a bearing of the apparatus of FIG. 1.
Figure 3:
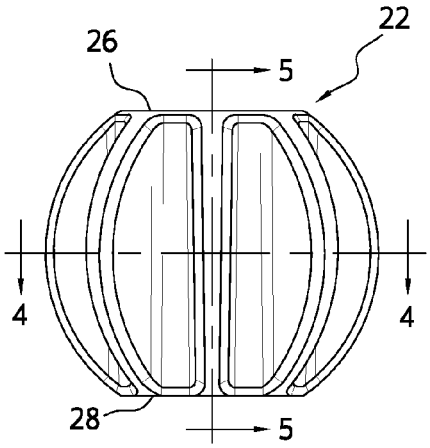
FIG. 3 is a front plant view of the bearing of FIG. 2.
Figure 4:
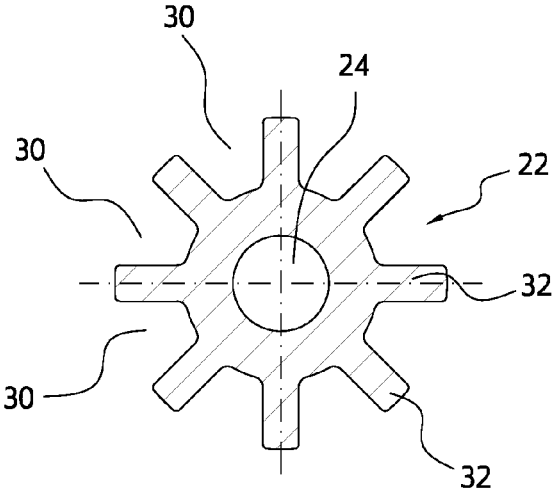
FIGS. 4 and 5 are sectional views of the bearing taken along lines 4-4 and 5-5, respectively, of FIG. 3.
Figure 5:
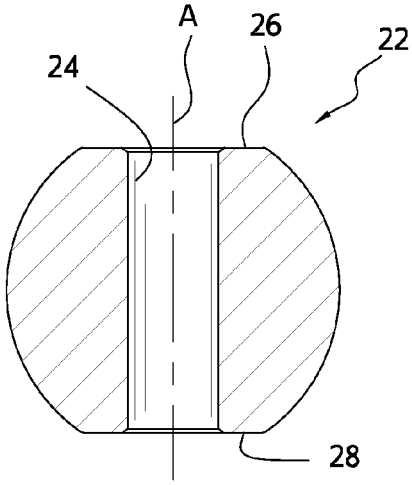

The apparatus for furling and unfurling a sail 2 on a sailboat according to the invention is shown in FIG. 1. The sail in FIG. 1 is a spinnaker, although the apparatus may be used to furl other types of sails as well. The apparatus includes an elongated flexible cord or cable 4. At one end, which in the drawing is the top end of the cable, an upper fitting 6 is connected with the cable. The upper fitting can be hoisted up to the top of a mast of the sailboat via a separate line 8 removably connected with the upper fitting. At the bottom of the cable is a lower fitting 10. Two corners of the sail are connected or lashed with the upper and lower fittings 6, 10, respectively, as shown in FIG. 1. The lower fitting 10 is removably connected with a swivel 12.

The swivel 12 creates a free running tack attachment point. A furling line 14 is wrapped around a lower pulley 16 of the swivel to rotate the swivel which in turn rotates the lower fitting 10 and the cable 4. When the cable is rotated in a first direction, the sail is wound around the cable from the top toward the bottom to furl the sail. When the swivel is released, the cable is free to rotate in the opposite direction to unfurl the sail. A ratchet block 18 is connected with the furling line to indicate the direction of furling and a tension system 20 is used to tension the furling line as is known in the art.

In order to protect the sail 2 from abrasion with the cable 4, a plurality of sail bearings 22 are mounted on the cable between the upper 6 and lower 10 fittings. The sail bearings will be described with reference to FIGS. 2-5.

Each sail bearing is formed of a rigid material such as synthetic plastic. The bearing has a generally spherical configuration and a longitudinal axis A. The bearing contains a cylindrical through-opening or bore 24. The diameter of the through-opening is slightly greater than the diameter of the cable on which the sail bearing is mounted. In order to assemble the furling apparatus, one of the upper and lower fittings is removed from the cable and a plurality of sail bearings are arranged on the cable by passing the cable through the through-bore of each bearing. The fitting is then replaced and secured to the cable. Because the diameter of the bearing through-opening is slightly greater than the outer diameter of the cable, the bearings are freely rotatable on the cable.

Each bearing preferably includes flattened top 26 and bottom 28 surfaces. Thus, when the bearings are arranged on the cable, the bottom surface of one bearing is supported by the top surface of the bearing beneath it, with the surfaces being in contiguous relation. Each bearing also preferably includes a plurality of grooves or channels 30 in the outer surface. The grooves extend parallel to the axis and are equally spaced about the circumference of the bearing. The grooves define a plurality of spaced flutes 32 on the outer surface of the bearing which further space the furled sail from the cable.

Figure 6:
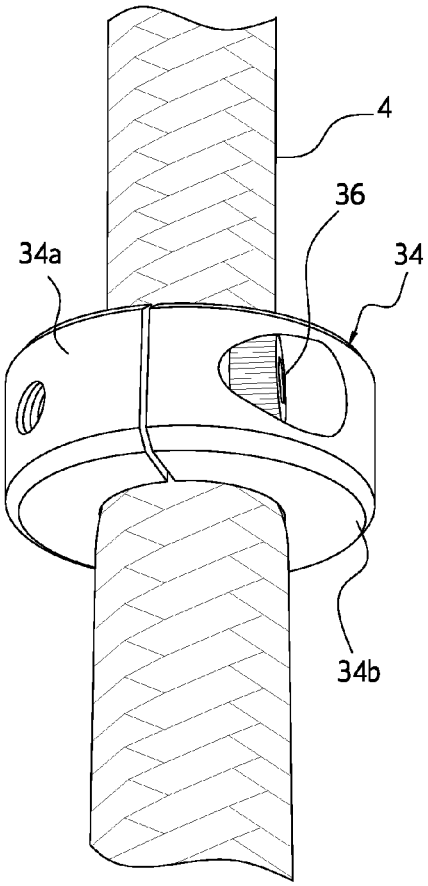
FIG. 6 is a perspective view of a bearing lock mounted on the cable of the apparatus.
Figure 7:
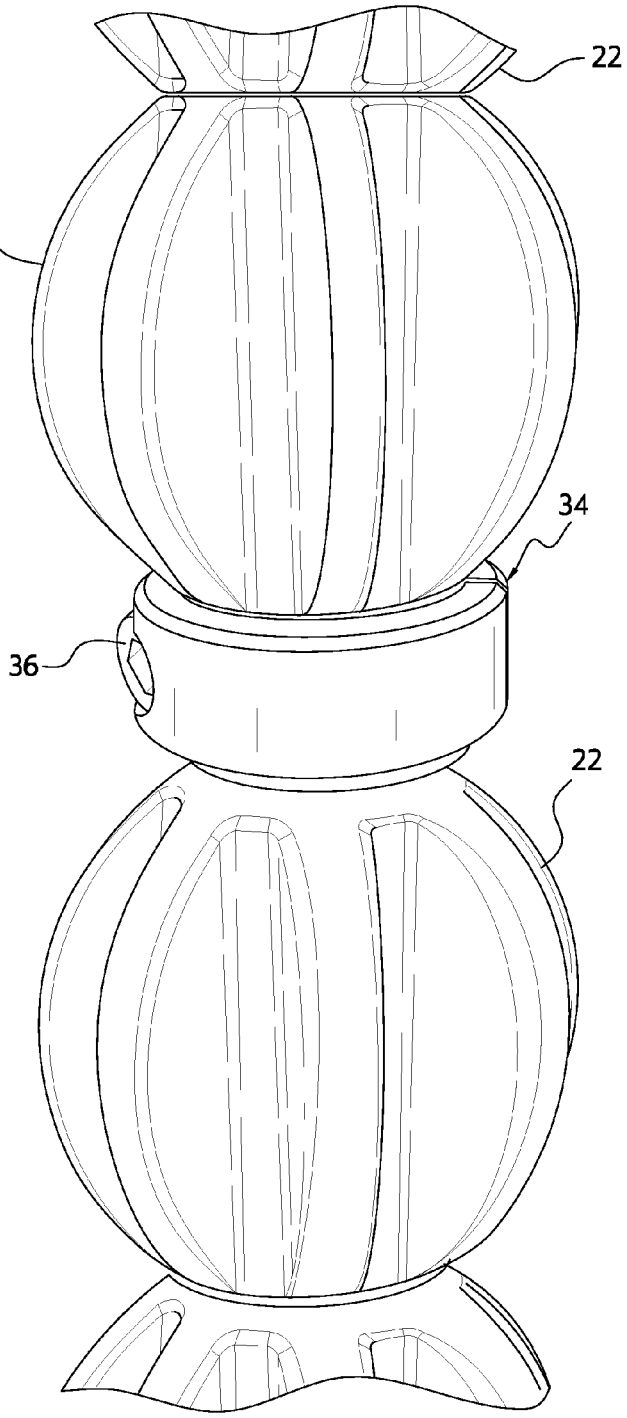
FIG. 7 is a plan view of the bearing lock with bearings arranged on the cable above and below the bearing lock.

One or more bearing locks 34 may also be provided on the cable between a pair of sail bearings as shown in FIG. 1. The bearing lock will be described in greater detail with reference to FIGS. 6 and 7. Each bearing lock 34 is formed of a rigid material such as metal. A lightweight aluminum material is preferred for the lock. It has an annular or donut configuration and includes a central through-opening. The lock is adjustable so that the diameter of the through-opening can be varied. The adjustment is provided by spreading apart two hinged portions 34*a* and 34*b* of the lock. This allows the lock to slide along the cable or cord when the lock is in the unlocked position. A locking screw 36 is arranged in aligned threaded openings in the hinged portions. As the screw is tightened, the lock is compressed against the cable so that it is secured in a locked position on the cable.

Each lock on the cable will support the sail bearings above it, until another lock is reached. The locks thus relieve the pressure on the sail bearings below the lock by eliminating the weight of the bearings above the locks. This insures that the sail bearings remain free to rotate relative to the cable. The free rotation of the sail bearings facilitates smooth furling and unfurling of the sail while also protecting the sail cloth from abrasive contact with the cable. Many cables are made of a fibrous metal such as KEVLAR material. The cable has a rough surface which can snag the sail if the sail bearings are not provided. With the sail bearings on the furling assembly, the life of the sail is extended significantly.

In the preferred embodiment, the sail bearings have a spherical configuration and multiple bearings are arranged on the cable. In an alternate embodiment, the bearing may have an elliptical configuration, with only a single bearing being arranged on the cable. If bearing locks are provided, elliptically shaped bearings can be arranged between the fitting and the lock and between the locks where more than one lock is provided. That is, there will be one more elliptical bearing provided on the cable than the number of bearing locks provided. This will insure that the bearings are freely rotatable on the cable for uniform furling and unfurling of the sail.

The sail bearings, though solid, are generally light weight. This makes it easy to disassemble the furling apparatus to stow the furled sail. After furling, the bottom fitting is disconnected from the swivel and can be inserted in a stowage bag. The line 8 can be released to gently lower the furled sail, with the sail being coiled in the bag. Once lowered, the line 8 is disconnected from the upper fitting 6 and the furled sail is stowed. The line can then be connected with the swivel until the sail is to be reconnected with the assembly for unfurling.

While the preferred forms and embodiments of the invention have been illustrated and described, it will be apparent to those of ordinary skill in the art that various changes and modifications may be made without deviating from the inventive concepts set forth above.

What is claimed is:

1. Apparatus for furling and unfurling a sail, comprising (a) a cable;

(b) upper and lower fittings connected with upper and lower ends of said cable, respectively, each fitting being connected with a corner of a sail;

(c) at least one bearing mounted on said cable between said upper and lower fittings, said bearing having a spherical configuration and being free for rotation relative to said cable; and (d) a swivel connected with said lower fitting, said swivel being driven in a first direction for rotating said cable to furl the sail on said bearing without contacting said cable, said swivel being released to allow said cable to rotate in a direction opposite said first direction to unfurl the sail.

2. Apparatus as defined in claim 1, and further comprising a plurality of bearings mounted on said cable, said bearings being arranged in contiguous relation.

3. Apparatus as defined in claim 1, wherein said bearing has a longitudinal axis and contains a cylindrical longitudinal through-opening for receiving said cable.

4. Apparatus as defined in claim 3, wherein said through-opening has a diameter greater than the diameter of said cable, whereby said bearing is freely rotatable with respect to said cable.

5. Apparatus as defined in claim 4, wherein said bearing contains a plurality of spaced grooves in an outer surface, said spaced grooves extending parallel to said longitudinal axis to define a plurality of flutes on said outer surface.

6. Apparatus as defined in claim 5, wherein said spaced grooves are equally spaced around the circumference of said bearing.

7. Apparatus as defined in claim 6, wherein said bearing is formed of a rigid material.

8. Apparatus as defined in claim 7, wherein said bearing is formed of synthetic plastic material.

9. Apparatus as defined in claim 2, and further comprising a bearing lock connected with said cable between at least one pair of adjacent bearings intermediate the upper and lower ends of said cable, said bearing lock supporting said bearings mounted on said cable above said bearing lock.

* * * * *